US008347582B1

(12) United States Patent
Thompson

(10) Patent No.: US 8,347,582 B1
(45) Date of Patent: Jan. 8, 2013

(54) VARIABLE PITCH CONNECTORS

(76) Inventor: Thomas C Thompson, Makakilo, HI (US)

( * ) Notice: Subject to any disclaimer, the term of this patent is extended or adjusted under 35 U.S.C. 154(b) by 0 days.

(21) Appl. No.: 12/928,993

(22) Filed: Dec. 22, 2010

(51) Int. Cl.
*E04C 5/00* (2006.01)
*E04B 1/38* (2006.01)

(52) U.S. Cl. ..... 52/712; 52/656.9

(58) Field of Classification Search ..... 52/712, 52/714, 715, 656.9; 403/231, 384
See application file for complete search history.

(56) References Cited

U.S. PATENT DOCUMENTS 1,346,736 A * 7/1920 Allee ..... 52/291
2,039,125 A * 4/1936 Stuart ..... 403/231
4,032,242 A * 6/1977 Morris ..... 403/231
5,160,211 A * 11/1992 Gilb ..... 403/231
5,277,408 A * 1/1994 Parker ..... 256/65.02
5,399,044 A * 3/1995 Gilb ..... 403/231
5,457,928 A * 10/1995 Sahnazarian ..... 52/702
5,722,212 A * 3/1998 Struve et al. ..... 52/712
5,761,863 A * 6/1998 Sutt et al. ..... 52/272
5,775,048 A * 7/1998 Orchard ..... 52/712
5,896,719 A * 4/1999 Thornton ..... 52/698
6,022,165 A * 2/2000 Lin ..... 403/231
7,516,580 B2 * 4/2009 Fennell, Jr. ..... 52/199
7,658,356 B1 * 2/2010 Nehls ..... 248/300
7,788,873 B2 * 9/2010 Leek ..... 52/702
2009/0190996 A1 * 7/2009 Clarke ..... 403/188

* cited by examiner

*Primary Examiner* — Christine T Cajilig

(57) ABSTRACT

An innovative retrofit connector with unique bends that add strength, and angled nailing that allow the connector to positively tie together intersecting wood structural members. The intersecting members can be horizontal, vertical, and of different slopes. The connector is simple to manufacture, doesn't split the wood, angles the nails or screws into the heart of the wood, and is strong. The connector helps protect an existing home against wind and seismic events.

9 Claims, 23 Drawing Sheets

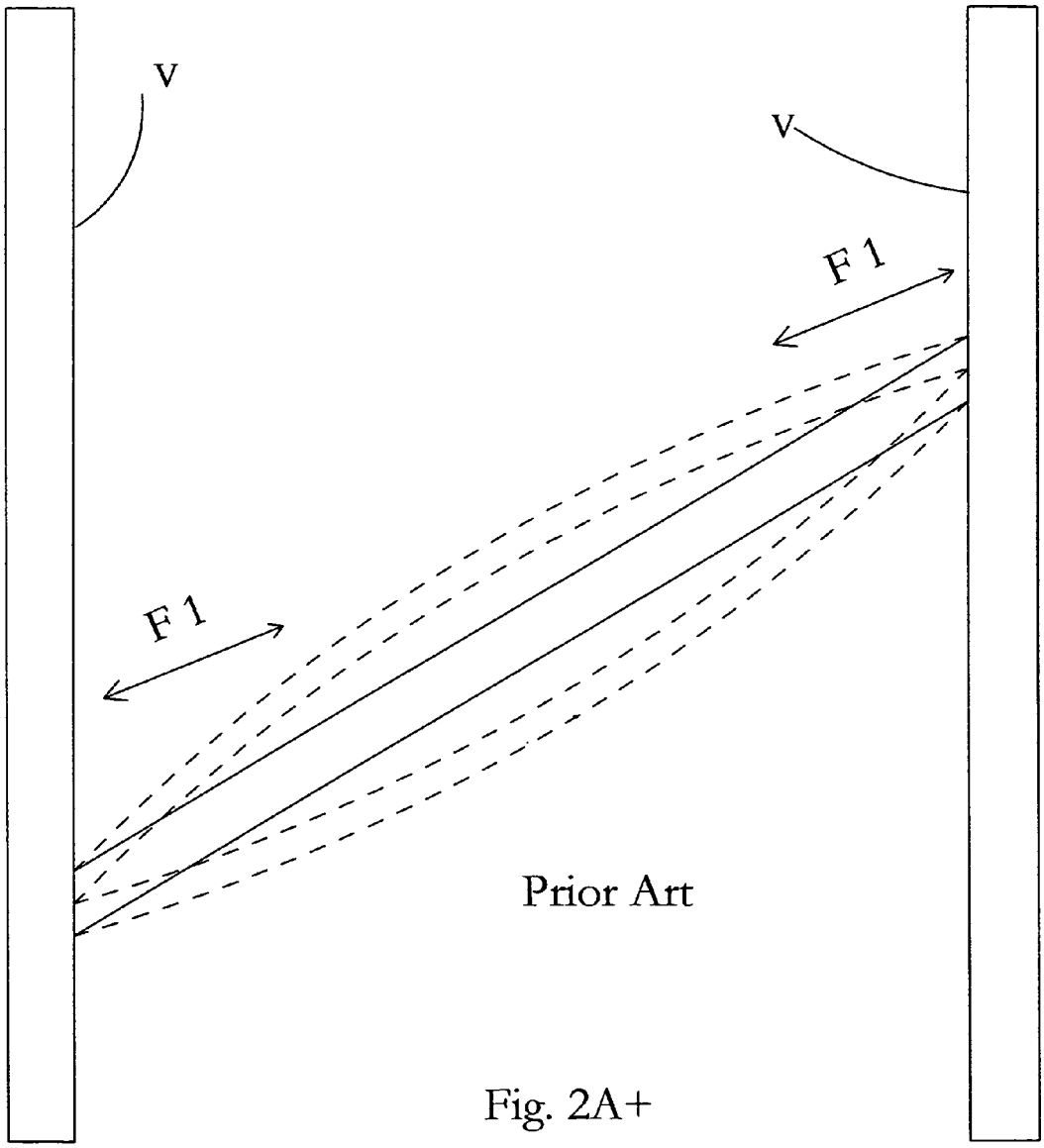
Fig. 2A+

Fig. 2B+

VARIABLE PITCH CONNECTORS

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

This invention relates to innovative retrofit connectors that permanently connect and strengthen intersecting structural members on a building. These connectors help create buildings that are stronger and more resistant to earthquakes and wind storms.

During an earthquake, the floor, wall, and roof diaphragms undergo shearing and bending. Because of the difference in weight, a roof can move at different speeds than the walls. The outside sheathing provides lateral stability to the walls, preventing racking. The sheathing also helps absorb and transfer seismic forces to the piers and foundation, and then back into the ground.

An earthquake can send motion into a house and separate structural members that are nailed together. The October, 2006 earthquake on the Big Island of Hawaii shook many homes off their piers. Because there is no frost, the foundations are shallow. Almost all the homes are made of wood construction. Many homes were damaged, which was unexpected because wood homes can usually absorb seismic forces.

Because of the active and ancient volcanoes making up the Hawaiian Islands, many homes in Hawaii are built on a slope. The rear of the house can be on the ground, with the front of the home 20 or more feet off the ground. The front of the house is usually on posts or stilts made from wooden beams.

Cross-bracing ties these tall posts together. The weak point is where the 2×4 cross-braces are connected to the posts. This invention helps strengthen the braces, and helps prevent the posts from moving off their piers, thus helping prevent the home from falling during earth movements.

Steel connectors, between different components of a wood-frame building's super-structure, provide continuity so that the building will move as a unit in response to seismic activity. This invention ties the homes sub-structure securely together, so the house will move as one unit.

Recent studies of hurricane damage on wood-frame buildings indicate that extensive damage was generated to a house by strong winds, when the building moved away from the foundation, and adjacent walls moved away from each other. Failure of the elevated part of a Hawaiian home is common during hurricanes, because wind can get underneath and lift one or several structural members of the home. This invention helps prevent the posts from detaching from other structural members.

Many homes that are built in temperate climates are situated on posts, such as in California where many homes are elevated on short posts called cripples. Many of these cripples are not tied together, just covered by lattice, but could be reinforced with the present invention.

The shear forces from the roof boundary members are transferred to the top of the walls and they travel down to the floor, to the posts, and to ground. The weakest connection is usually the one that fails. To withstand and transfer the shear loads, the connection between the floor and foundation must be strong.

The cross-bracing provides lateral stability to the posts, preventing racking. The cross bracing also absorbs and transfers earthquake forces to the foundation. Unique steel connectors help strengthen and stabilize the cross-braces, and many other intersecting structural members.

2. Prior Art

Prior art connectors utilizing angled nailing were only concerned with three areas: (1) prevention of wood splitting due to wood shrinkage, (2) prevention of splitting of laminated wood members such as plywood glued laminated timbers (glulam and prefabricated wood joists (microlams), and (3) insertion of fasteners through a held member and a holding member which are joined by a special connector so that a plurality of fasteners will be in double shear. The first two problem areas are fully discussed in Gilb U.S. Pat. No. 4,291,996 Sep. 29, 1981, and the third problem area is discussed in Gilb and Commins U.S. Pat. No. 4,480,941 granted Nov. 6, 1984. These were also discussed in Leek, et al. U.S. Pat. No. 5,603,580 granted Feb. 18, 1997.

Gilb's 966' taught the use of a slot-like opening in the face of the metal connector and then bending out a tab-like member formed from the displaced material. The tab-like device has been commercially successful with thousands of hangers carrying the positive angle nailing device.

But the tab-like device has several problems as set forth as follows: (1) the punching of a slot has a similar effect of punching a large opening in the metal which tends to weaken the metal; (2) the tab protruding from the metal tends to snag on other building materials prior to installation; (3) the protruding tab has invited installers who are not familiar with the purpose of the tab to forcibly bend the tab with a hammer or pair of pliers, thereby destroying the purpose of the tab; the tab is relatively easily bent during non-aligned hammering of the fastener during installation and (5) while the cost of forming the tab is minimal, yet it does require two stations; viz, a cutting station and a bending station thereby adding to the cost of manufacture.

Gilb and Commins 941' uses angled nailing on a connector that wraps on two sides of a wood member, like a joist hanger. Angled nailing from opposite sides of the wood member cross each other forming double-shear nailing. This basically means that a force pulling on one direction pulls the opposite nail deeper into the wood. This only works on a connector that wraps on two sides of a wood member, or in the present invention, when two connectors are used on opposite sides.

Leek's 580' uses a nail hole-sized, dome-shaped opening to angle the nail into the wood member. The dome-shape does not snag, and does not make a bigger hole in the metal connector than the nail hole itself. But it still makes a hole in the material and protrudes.

Up until this invention, the only method of making angled nailing was angling the nail hole. It was done by cutouts or by doming. No one had thought about angling the face of the connector, or if they did, how to do it properly.

There are a few connectors made for connecting sloped structural members. The Simpson Strong Tie Company catalog shows several connectors that are bent at the building site by a contractor. Their Adjustable Light Slopable Hanger (LSU), and Jack Truss Connector (TJC37) are bent in the field along a centerline of slots. Both are not patented.

The Simpson Strong Tie Company catalog shows three patented connectors for sloped structural members. Like Simpson's above connectors, all these connectors are field-bent to the desired angle. Field bending of a clip to fit on sloped structural members is described in Gibb, U.S. Pat. No. 4,410,294 granted Aug. 9, 1994; Callies, U.S. Pat. No. 5,230,198 granted Jul. 27, 1993; and Horne, U.S. Pat. No. 6,772,570 granted Aug. 10, 2004.

3. Objects and Advantages

Accordingly, several objects and advantages of my invention are that it helps secure intersecting structural members of a building to make the building a solid unit and helping prevent it from being destroyed by hurricanes and earthquakes.

One advantage is this invention doesn't split the wood, because the nail is driven away from the edge of the wood. When the invention is installed, it helps hold the edge of the wood together.

Another advantage is that the driven nail is at an acute angle into the heart of the wood member. A nail driven perpendicular near the edge of a flush face is more prone to forces that can pull straight on the nail. But an angled nail must usually be sheared, as it's difficult to pull it out from the heart of the wood at an angle. Wind or seismic events usually create forces that try to pull structural members straight apart.

Still another advantage is that this invention can use a longer nail in the wood. A 2×4 is actually 1½ inches thick. This invention puts the nail at an angle into the heart of the wood. That means that a 2½-inch nail can be used, instead of a 1½-inch nail. Two inches of the nail will be angled into the wood. A longer nail means deeper penetration into the wood member.

Another advantage is that this invention makes it easier to nail. By placing the nailing surface at an angle to the intersecting structural members, a contractor can easily swing a hammer, and hit the nail head squarely with the hammer. Most other connectors have the nails near the edge of the structural member, and perpendicular to it making nailing difficult.

Still another advantage of this invention is that it is stronger than prior art connectors because of the double bend at the angled nail, instead of a single bend. This invention lies against both structural members. This invention is simple to manufacture. This invention uses a nail hole with no deformation. This invention has no snagging.

Another advantage is that this invention helps prevent wood structural members from twisting and flexing during strong winds and seismic events, thereby preventing detaching of structural members from each other. It stiffens the connection of two intersecting structural members, helping to transfer lateral or lifting loads throughout the building and into the foundation.

Still another advantage is this invention helps prevent splitting of laminated wood members such as plywood glued laminated timbers (glulam and prefabricated wood joists (microlams). This invention drives nails at an acute or right angle into the layers of the plywood.

During an earthquake or a hurricane, a building with this invention will be a sturdier unit, resisting and transferring destructive forces to the ground.

Many homes were constructed with the best materials and by competent carpenters, but used the time-honored method of connecting slopped and intersecting structural members with toe nails. Toe-nailing drives the nail from near the edge of one structural member into an adjacent structural member. This weak connection is still in use today. Earth tremors and hurricanes always destroy the weakest parts of a house. By making the connections strong, there will be less damage.

It is a further object of this invention that it easily and quickly protects houses from the destructive forces of earthquakes and hurricanes. It is a still further object that the connectors are strong, attractive, permanent, functional, uncomplicated, simple to manufacture, easy to install, and economical. All embodiments can be made from a single sheet metal blank, without welding.

As a retrofit, a handy homeowner can install this invention, or have it installed. The homeowner can easily see that the home is protected instead of wondering if metal connectors were installed correctly during construction, or installed at all. As a retrofit, an insurance agent can observe that the home is protected and give appropriate discounts. Perspective home buyers can perceive that the building is protected, so the seller can ask for a better price.

Since this invention cradles the structural member, and has a wide base anchored to the member, torsional twisting and flexing of the member is significantly reduced over prior art hurricane clips, as is cross-grain splitting. Edges of the connector are slightly rounded for strength, ease of handling, and avoiding stress-fracturing associated with sharp corners.

These and other objectives of the invention are achieved by simple and economical connectors that allow a contractor or home owner to easily secure the weakest parts of a building against earth tremors and high winds. Advantages of each will be discussed in the description. Further objects and advantages of my invention will become apparent from a consideration of the drawings and ensuing description.

SUMMARY

An innovative retrofit connector with unique bends that add strength, and angled nailing that allow the connector to positively tie together intersecting wood structural members. The intersecting members can be horizontal, vertical, and sloped. The connector is simple to manufacture, doesn't split the wood, angles the nails or screws into the heart of the wood, and is strong. The connector helps protect an existing home against wind and seismic events.

BRIEF DESCRIPTION OF DRAWINGS

FIG. 11 Flat pattern layout of a slope connector.

FIG. 2A+ Side view of lateral forces on a typical knee brace.

FIG. 2B+ Simple cross-section showing angled nailing.

Figure 1:
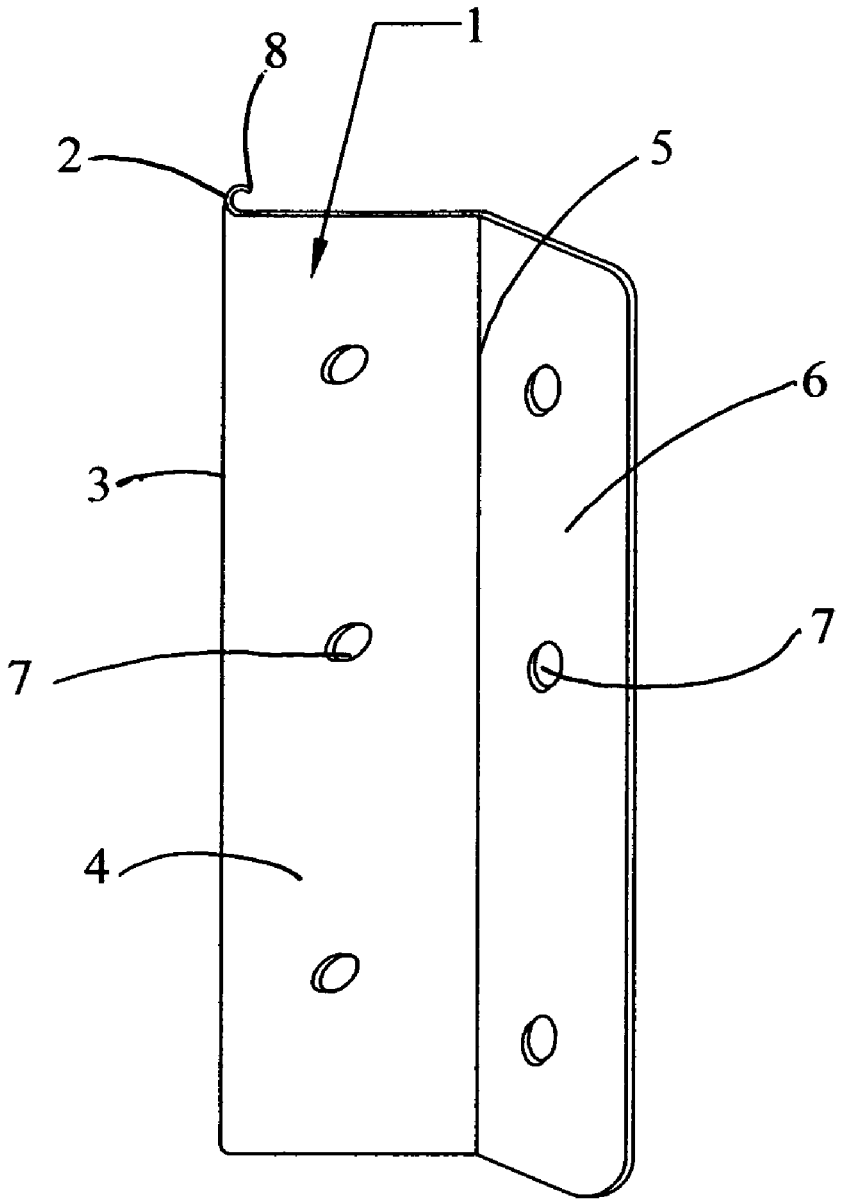
FIG. 1 Perspective view of a slope connector.

| REFERENCE NUMERALS IN DRAWINGS | |
|---|---|
| 1. | Slope connector |
| 2. | Radius web |
| 3. | Radius bend |
| 4. | Angled face |
| 5. | Base bend |
| 6. | Base web |
| 7. | Nail hole |
| 8. | Radius web |
| 9. | Taunt web |
| 10. | Gusset connector |
| 11. | Variable pitch connector |
| 12. | Stabilizer web |
| 13. | Radius lip |
| 14. | Radius web |
| 15. | Radius bend |

-continued

| REFERENCE NUMERALS IN DRAWINGS | |
|---|---|
| 16. | Angled face |
| 17. | Plate bend |
| 18. | Plate web |
| 19. | Nail hole |
| 20. | Stress reliever |
| 21. | Relief |
| 22. | Strengthening bend |
| 23. | Triangle leg bends |
| 24. | Triangle |
| N. | Nail |
| H. | Horizontal beam |
| V. | Vertical beam |
| S. | Brace stabilizer |
| T. | Tofu block |

DESCRIPTION

The present invention is a sheet-metal retrofit connector for joining intersecting structural members on a building that meet at any angle, such as a knee brace. During a seismic event, it prevents the knee brace from disconnecting or buckling. This invention contains connectors with unique faces and bends.

The main focus of this new invention is to make a formerly toe-nailed connection stronger by adding a steel connector. Adding a connector onto a sloped structural member has usually been done by bending the connector on the building. That means that the connector had to be thin, or have bending slots that make the connector weak.

The other problem on angled or sloping structural members is that it was difficult to nail or screw on any connector. Where a knee-brace is just below a floor joist, there is no room to swing a hammer or fit a screw gun. This invention puts the driving nails or screws at an angle to the structural member to make attachment easier.

The angled nailing device on the invention angles the nail toward the interior of the wood, thereby helping prevent the edge of the structural member from splitting. The unique bends add material in strategic places on the invention to make it stronger. Having the connector bent at the factory work-hardens the metal and makes the entire connector stronger.

This invention relates to retrofit seismic and hurricane clips that are strong, easy to install, and protect an existing home against wind and seismic events. The invention can be used where most structural members are joined together at a slope, where it is difficult to hammer or screw, and where the contractor does not want to split the edge of the wood.

Refer now to FIG. 1 which shows a perspective view of a rectangular slope connector 1. The base web 6 is connected to the angled face 4 by the base bend 5, bent at an acute angle. Both the base web 6 and the angled face 4 are rectangular and have nail holes 7. Opposite the base bend 5, the other long side of the rectangle is the obtuse radius bend 3, bent in the opposite direction of the acute base bend 5. The radius bend 3 forms a radius 2 which culminates in the radius lip 8.

The two bends 5 and 3 make the clip strong. The bends 5 and 3 work-harden the metal and stiffen it. The rolled radius web 2 also adds strength, as it forms half a tube, which is more resistant against twisting, folding, or compression than flat metal.

Figure 1A:
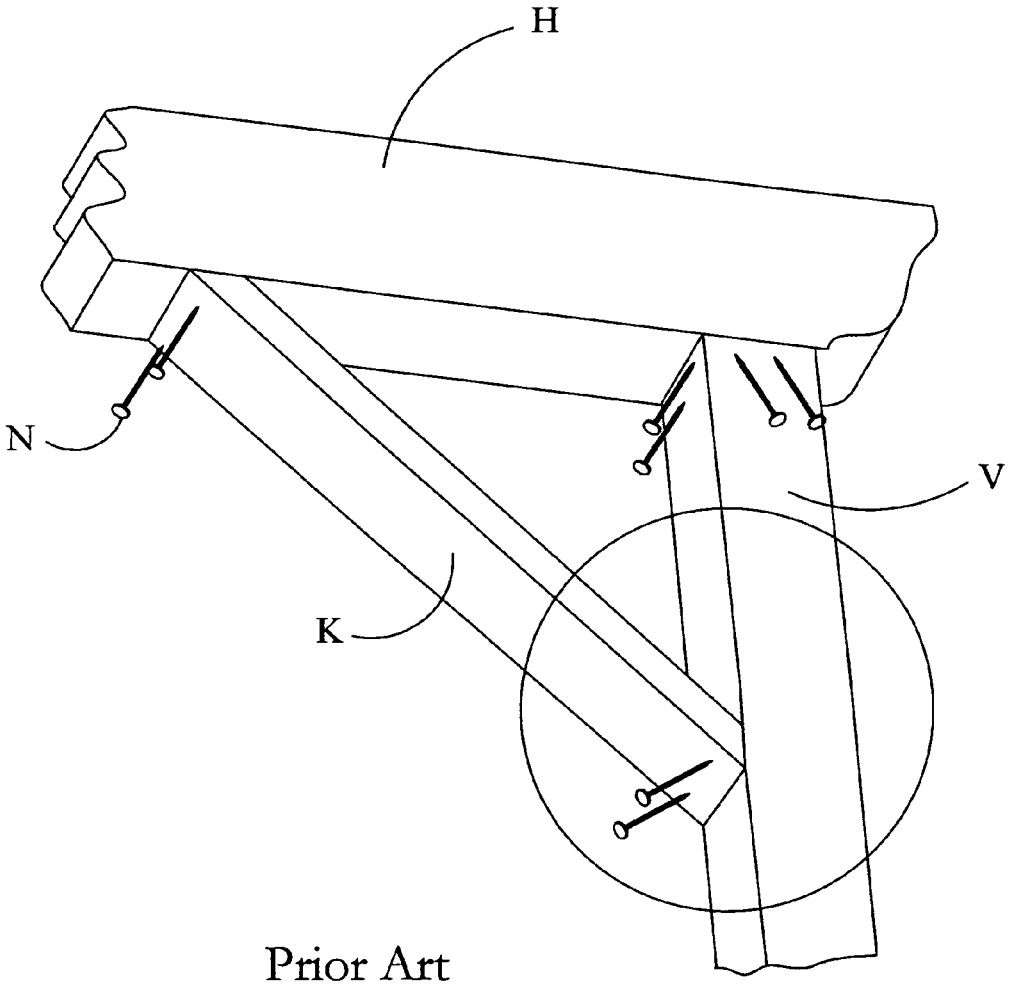
FIG. 1A Perspective view of a typical knee brace on a building.

Refer now to FIG. 1A which shows a perspective view of a typical knee brace on an existing home. The knee brace K is usually a 2×4 that helps stabilize a horizontal structural member H and a vertical structural member V, and keeps the vertical members V from racking. In this view, the horizontal member could be a floor joist, and the vertical member could be a cripple. These structural members are often hid by lattice or siding.

Figure 1B:
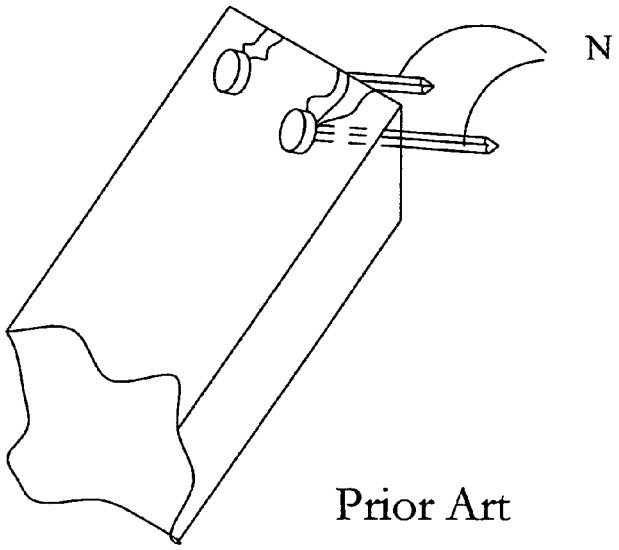
Prior Art Fig. 1B
FIG. 1B Perspective view of toe-nails showing wood splitting.
Figure 1C:
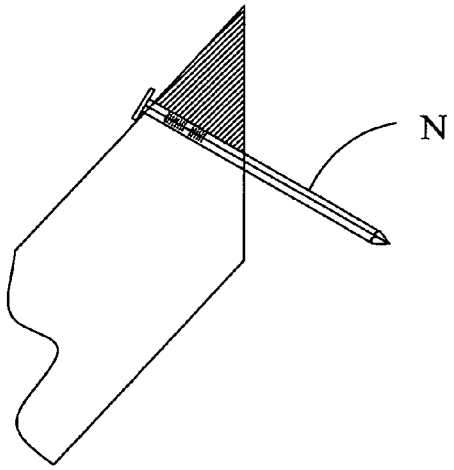
Prior Art Fig. 1C
FIG. 1C Simple cross-section showing small part of wood held by toe-nailing.

The knee brace K was usually joined to the horizontal and vertical members by toe-nailing. A carpenter would place a nail N near the edge of the knee brace K and nail it at an angle into the adjacent structural members. FIGS. 1B and 1C will be shown from the circled section on FIG. 1A.

Refer now to FIG. 1B which shows a perspective view of one of the problems with toe-nailing. When nails are toe-nailed into the edge of the wood member, they can split the wood above the nail. The wood grain is along the length of the knee brace, so the nails N can split the thin wedge of wood.

Refer now to FIG. 1C which shows a simple cross-section (hatched) of the wedge of wood that a toe-nail N forms on the sloped member. A strong force could break the connection.

Figure 1D:
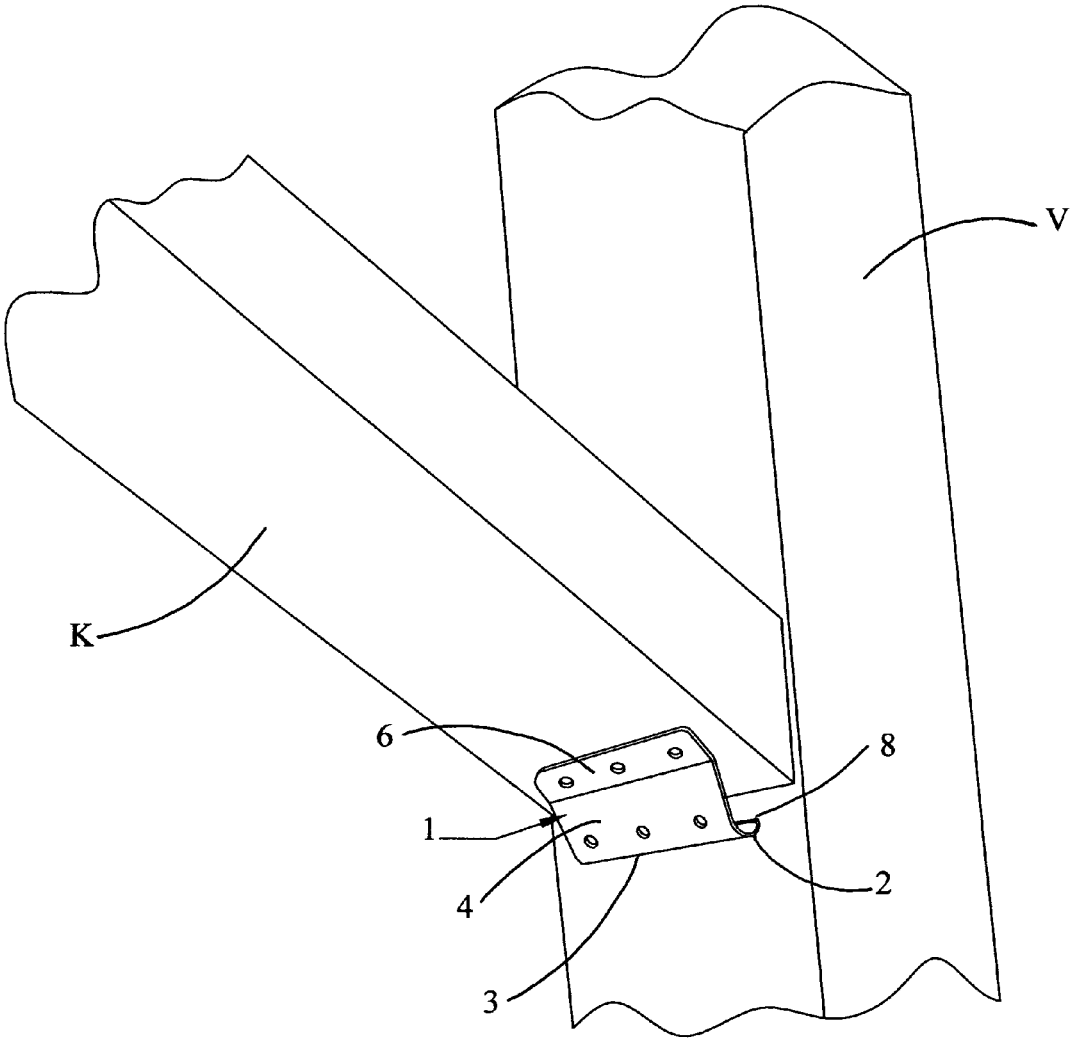
FIG. 1D Perspective view of a slope connector on a slopped knee brace.

Refer now to FIG. 1D which shows a perspective of the slope connector 1 attached to the bottom of a typical, sloped knee-brace K and vertical member V. The bottom of the knee brace K forms an obtuse angle with the vertical member V.

The slope connector has the base web 6 and base bend 5 attached to the knee brace K, and the radius lip 8 and/or the radius web 2 against the vertical member V, depending on the slope. Nails N are then driven at an angle, through the nail holes 7 on the angled face 4, for a tight and strong connection.

Figure 1F:
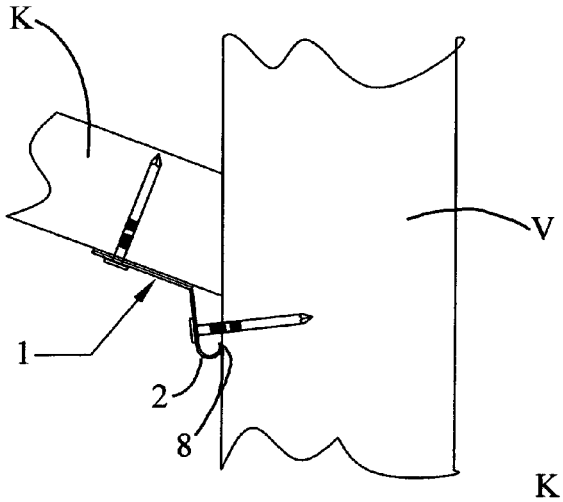
FIG. 1F Side view of a slope connector on a shallow-slope knee brace.
Figure 1E:
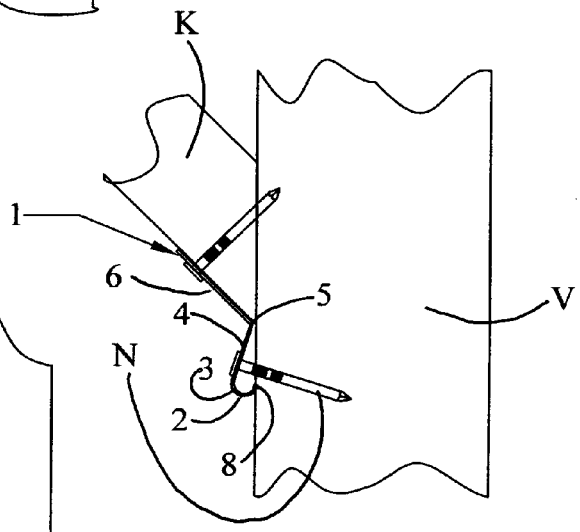
FIG. 1E Side view of a slope connector on a steep-slope knee brace.

Refer now to FIG. 1E which shows a simple cross-section of the nailing into the knee brace K and vertical member V shown on FIG. 1D. A toe-nail would have only caught a tiny edge of the knee brace K. Only the nail closest to the viewer is shown, but the slope connector 1 places a plurality of nails N into the heart of the knee brace K, through the base web 6. The slope connector 1 also places angled nails N through the angled face 4 and into the heart of the vertical member V. The slope connector 1 also has the radius lip 8 and base bend 5 against the vertical member V. The slope connector 1 forms a much stronger connection than toe-nailing. It can also be seen that longer nails could be used and they would go into the heart of the wood.

Refer now to FIG. 1F which shows a simple cross-section of a shallow-slope knee brace K. The slope connector 1 has the radius lip 8 and radius web 2 against the vertical member V.

Figure 1G:
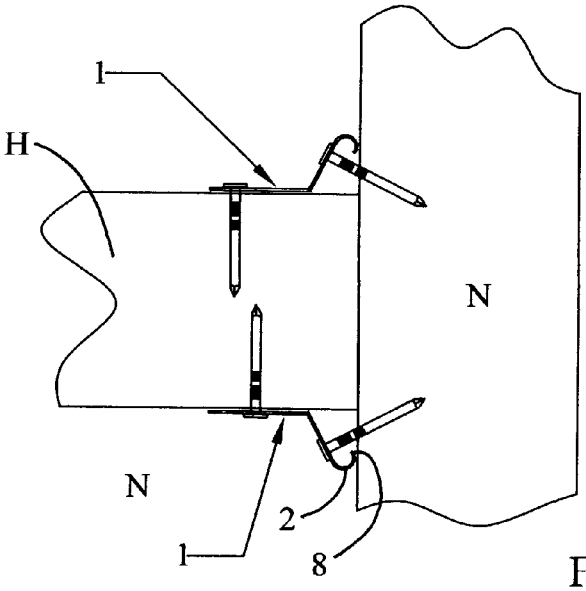
FIG. 1G Side view of a slope connector on a horizontal member.

Refer now to FIG. 1G which shows a simple cross-section of a horizontal member H and vertical member V. The slope connector 1 has the radius web 2 against the vertical member V. FIGS. 1E to 1G show that the slope connector can work on different slopes.

Figure 1H:
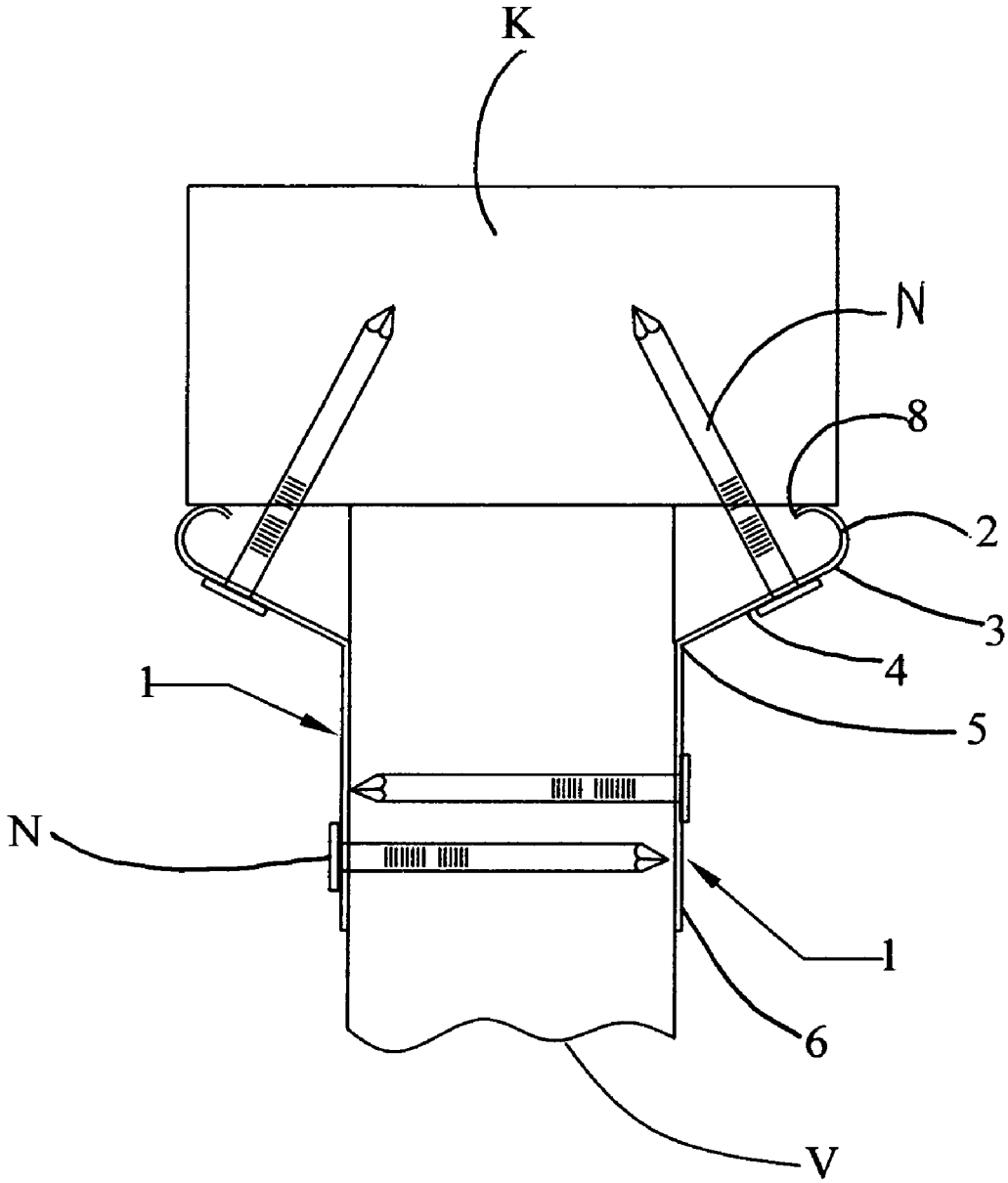
FIG. 1H Simple cross-section of two slope connectors on a vertical member.

In certain structural applications, the narrow part of a 2×4 can be attached to the wide part of a 2×4. Refer now to FIG. 1H which shows a simple cross-section through a cross-brace K and a stabilizing member S. A long nail could be driven from the top of the cross-brace K, but it could split the wood if it is not driven perfectly straight. Another problem is that the 2×4 is 3½-inches-wide, and 1½-inches-thick. If the knee-brace K is placed in the center, only one inch of wood is available on each side for toe-nailing.

Slope connectors 1 placed on the left and right help securely tie the knee-brace K to the stabilizing member S. On the right side of FIG. 1H, the cross-section shows how a slope connector 1 was placed with the base web 6 flush against the stabilizing member S. It was slid up so the radius lip 8 and part of the radius web 2 were flush against the knee-brace K, and then nails N were driven through the base web 6 into the stabilizing member S. Then nails N were driven through the angled face 4 into the knee-brace K for a strong connection. The same was done on the left.

Figures 1I, 2Q:
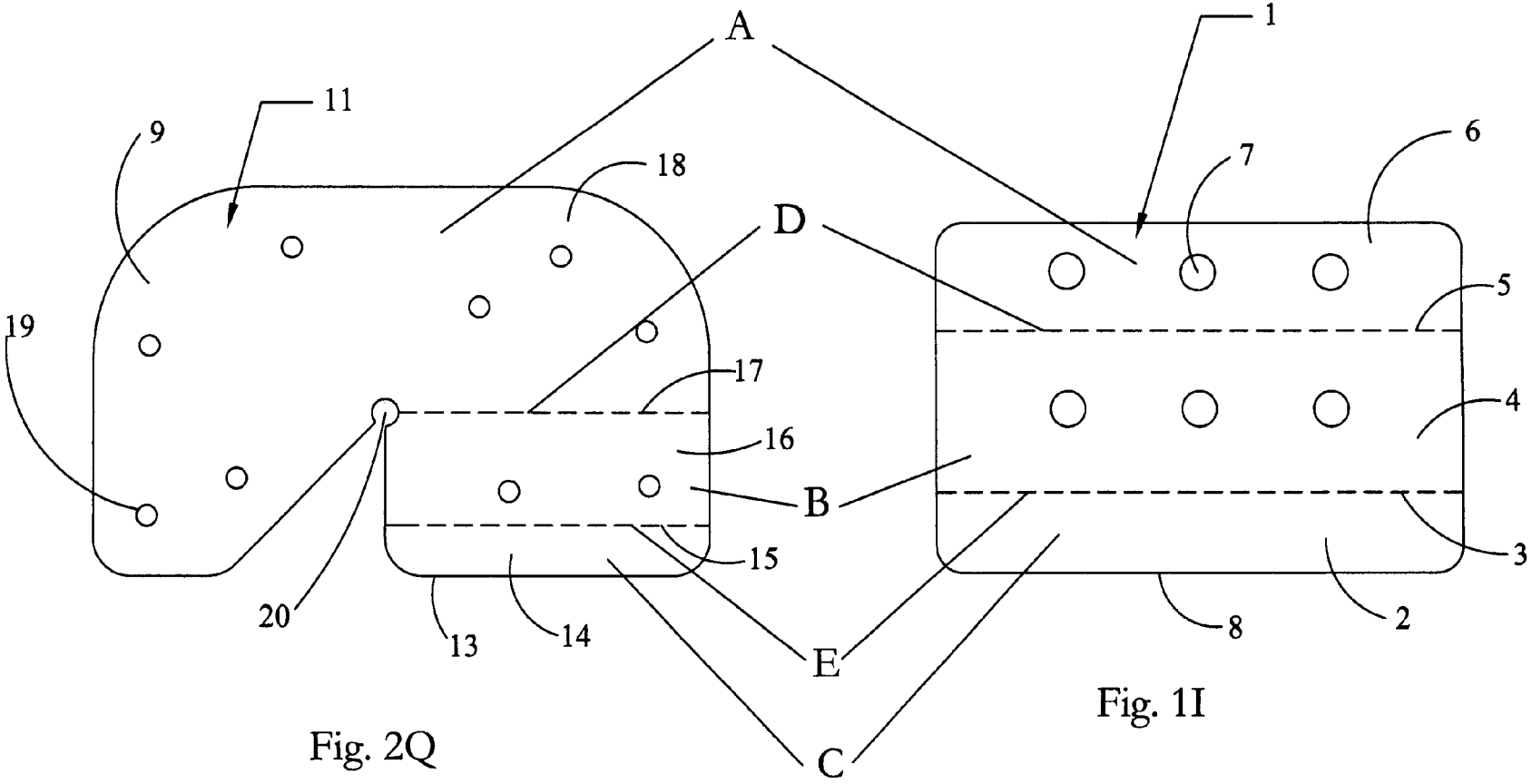
FIG. 2Q Flat pattern layout of a right variable pitch connector.

Refer now to FIG. 1I which shows a preferable flat pattern layout for a slope connector 1 before bending. One slope connector 1 can work on the left or right, so only one pattern is needed for the tool and die maker to form.

Figure 2:
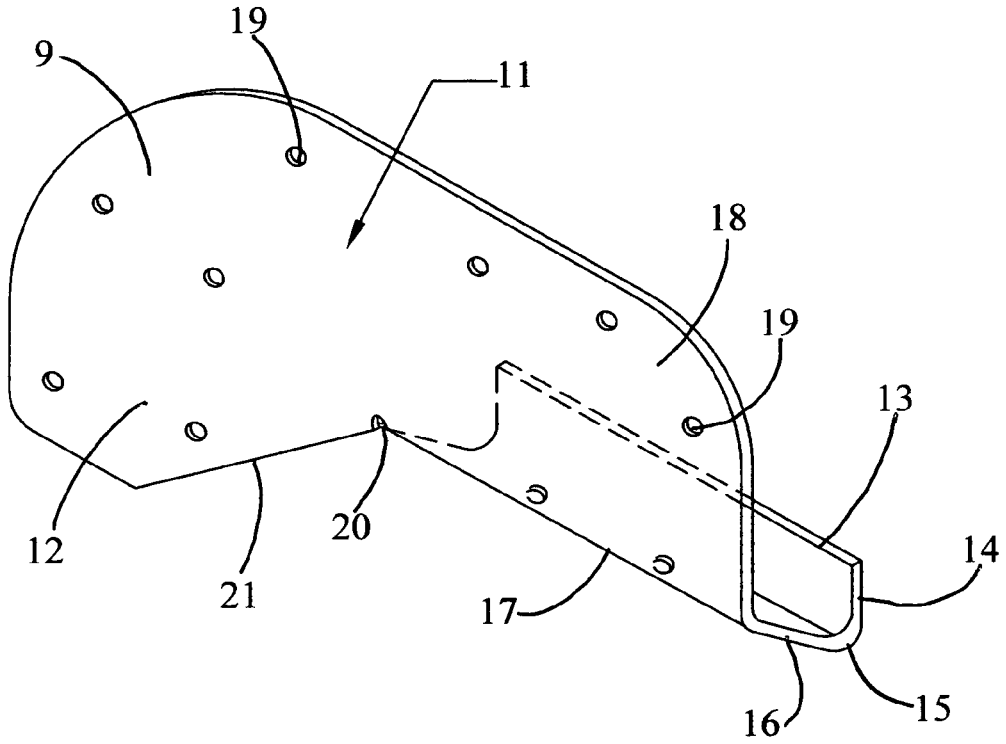
FIG. 2 Perspective view of a variable pitch connector.

Refer now to FIG. 2 which is a perspective view of a variable pitch connector 11. The connector is rectangular with rounded corners. The stabilizer web 12 makes up most of the left side in this view. The upper right has the plate web 18, and below that is the plate bend 17 bent under the plate web 18 and reliefs 20 and 21 to prevent stress. Attached to the plate bend 17 are a bend, a radius, and two webs. It is similar to the bends on the slope connector 1, except the bends are only on apart of the connector. An angled face 16 comes off the plate bend 17 and a radius bend 15 forms a half tube-shaped radius web 14 and radius lip 13 at the end.

Figure 2A:
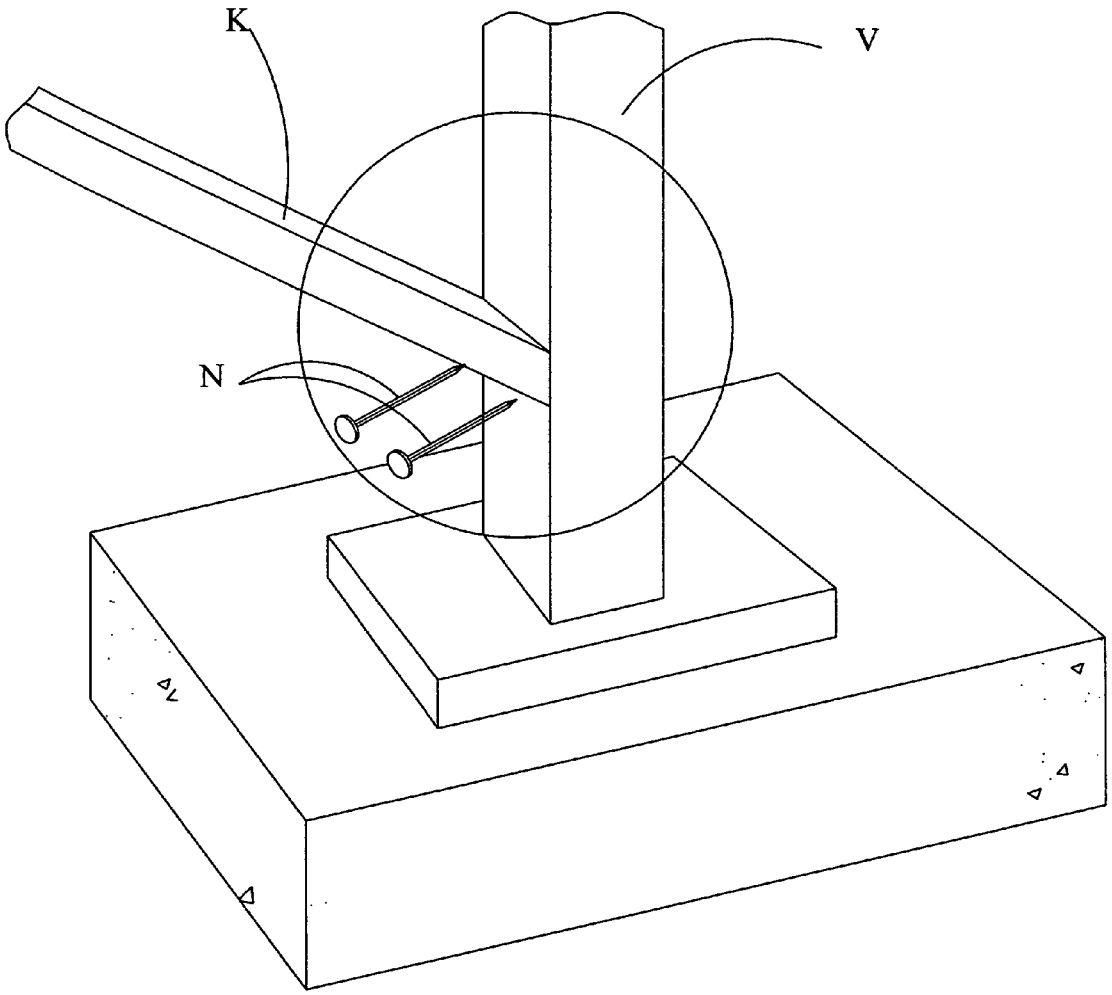
Prior Art Fig. 2A
FIG. 2A Perspective view of a typical knee brace on a building.

Refer now to FIG. 2A which shows a block foundation T, vertical structural member V, and knee brace K. The sloping knee brace K is toe-nailed to the vertical member V by nails N. In Hawaii, with no frost zone, the vertical post rest on a small concrete pad called a "tofu block" because of the similar size. During the 2006 earthquake on the Big Island, many posts were shaken off the tofu block and the home was damaged.

FIG. 2A also shows the orientation of a typical knee brace K. In a typical 2×4, if the board is supported at either end, the board is stiff when it is placed on its thin edge, but flexible when it is placed on its wide edge. In FIG. 2A, it can be seen that the 2×4 of the knee brace K is flexible in reaction to lateral forces. A force that would move the home left-to-right, such as applied by a seismic event, could cause the knee brace K to flex up-and-down. This could cause the toe-nailed connection to detach. Since the knee brace K helps keep the vertical members V from racking, the building could fall down if the knee braces K detach from the vertical members V.

Refer now to FIG. 2A+ which shows a side view of a knee brace K between two vertical members V. A seismic or wind force could apply a lateral force or sideways force, F1, on the two vertical members V. As stated above, the 2×4 can flex up-and-down to these lateral forces, and could detach the toe-nailed connection.

Figure 2B:
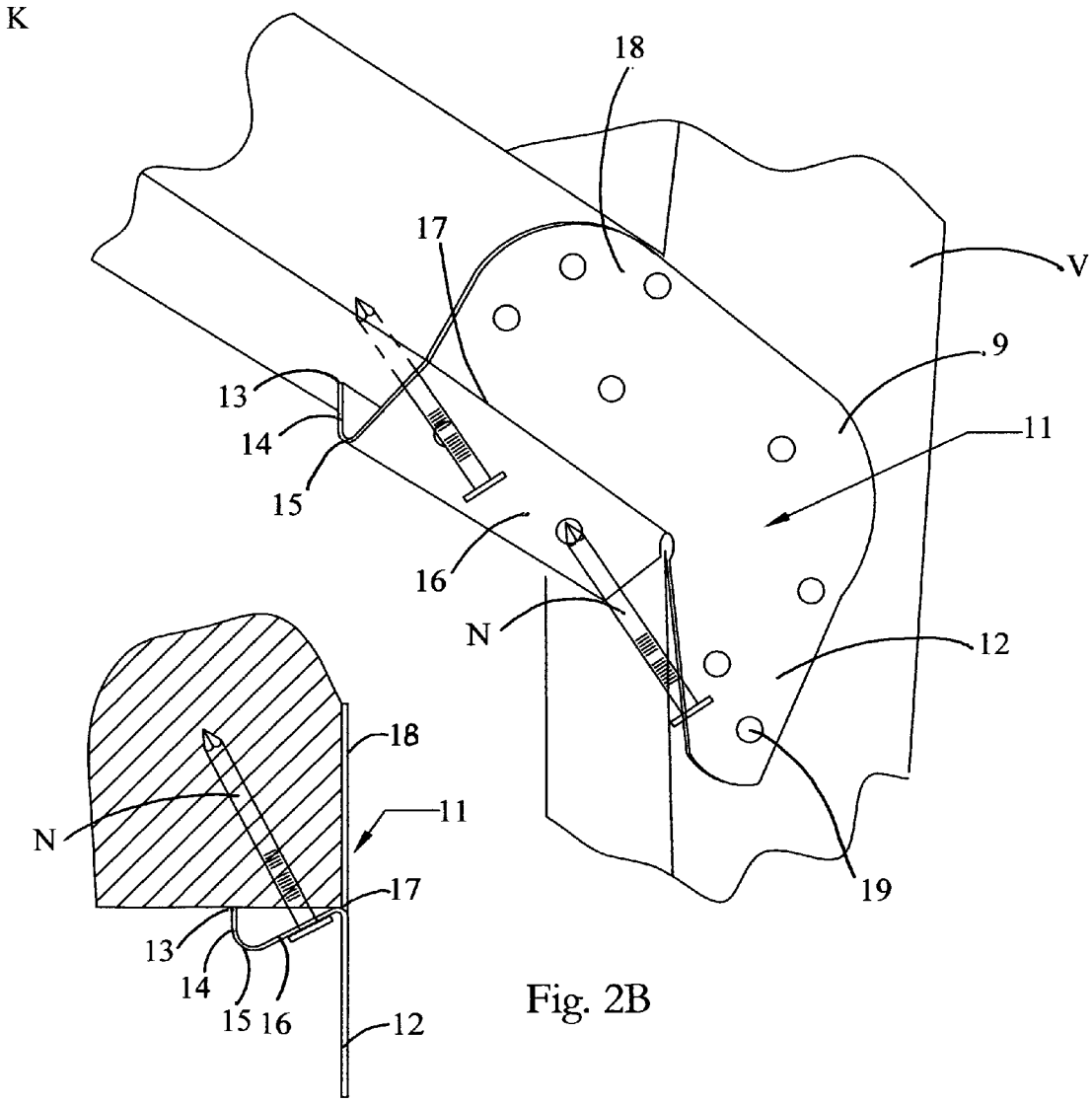
FIG. 2B Perspective view of a left variable pitch connector on a steep-slope knee-brace.

Here's a solution. Refer now to FIG. 2B which shows a left variable pitch connector 11 attached to the side of a vertical member V, the side of a sloped knee brace K, and the bottom of a knee brace K. The stabilizer web 12 and taunt web 9 are attached to the side of the vertical member V. The plate web 18 and plate bend 17 are attached to the side of the knee brace K.

To install, the variable pitch connector 11 is placed against the vertical member V so the taunt web 9 and stabilizer web 12 are flush against the side of the vertical member V. The angled face 16 and attached parts are between the knee brace K and vertical member V. Then the entire connector is rotated clockwise, keeping the taunt web 9 and stabilizer web 12 flush against the vertical member V, until the plate bend 17 and radius lip 13 are flush against the knee brace K. Then nails or screws are driven into the vertical member V and angled into the knee brace K.

FIG. 2B shows how the nails N driven into the nail holes 19 of the angled face 16 are angled into the heart of the knee brace K. On the bottom of the knee brace K, the plate bend 17 and the radius lip 13 are against the bottom of the knee brace K. The left nail N, partly driven through the nail hole 19 on the angled face 16, is heading into the heart of the knee brace K. The right nail N is positioned for driving at an angle. This connector makes a strong connection that is resistant to lateral or up-and-down movements.

Previously, it was difficult to nail up from underneath the knee brace K especially if it was down near the foundation or up near the floor joist. It would be difficult to swing a hammer or use a powered screwdriver. But swinging a hammer to get to nails on the angled face 16 is easier. Nails N driven at an angle on the angled face 16, are much easier to drive.

Refer now to FIG. 2B+ which shows a simple cross-section of angled nailing into the sloped knee brace K. The plate web 18 is flush against the knee brace K, the stabilizer web 12 is flush against the vertical member V, and the plate bend 17 and radius lip 13 are flush against the bottom of the knee brace K. The angled nail N is driven into the heart of the knee brace K, through nail holes on the angled face 16.

Figure 2C:
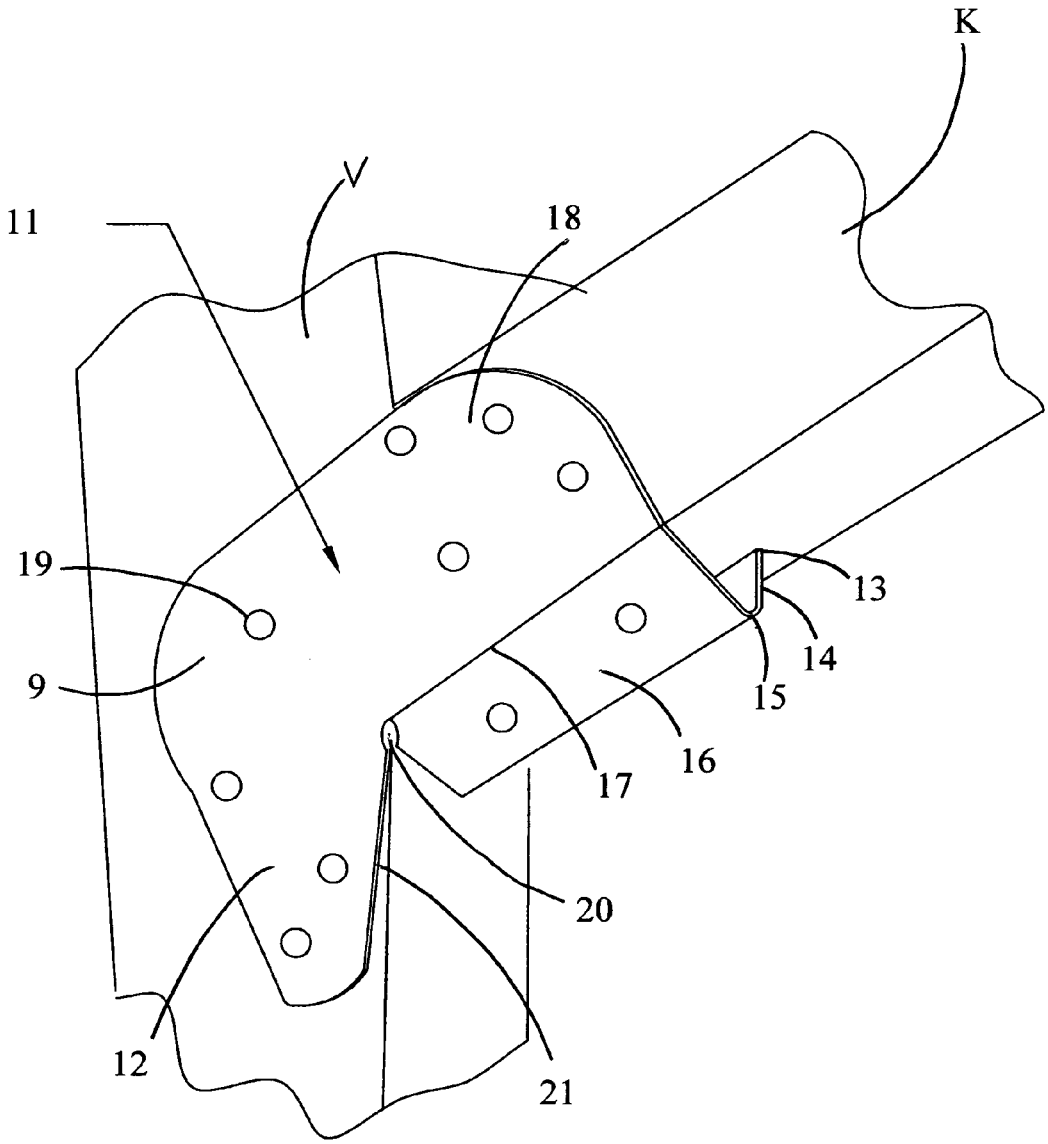
FIG. 2C Perspective view of a right variable pitch connector on a steep-slope knee-brace.

Refer now to FIG. 2C which shows a right variable pitch connector 11. It is installed the same as the left, but in this figure the connector is rotated counterclockwise. Putting a left and right connector on the knee brace K and vertical member V makes a strong connection. With both connectors installed on a knee brace K, the radius lips 13 would not touch each other.

Figure 2D:
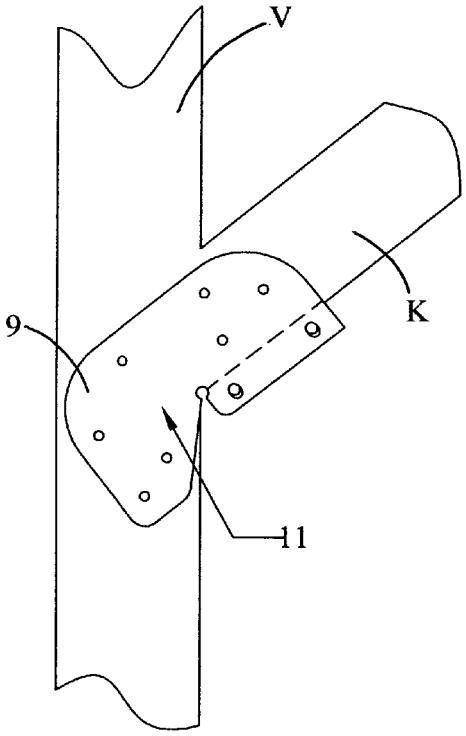
FIG. 2D Side view of a left variable pitch connector on a steep-slope knee-brace.
Figure 2F:
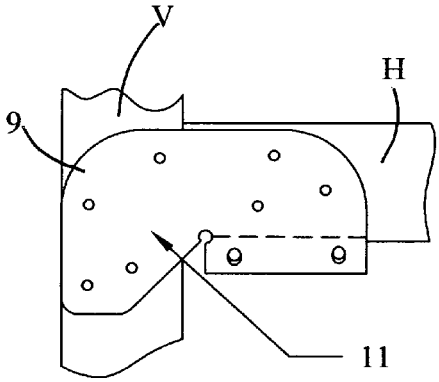
FIG. 2F Side view of a left variable pitch connector on a horizontal member.
Figure 2E:
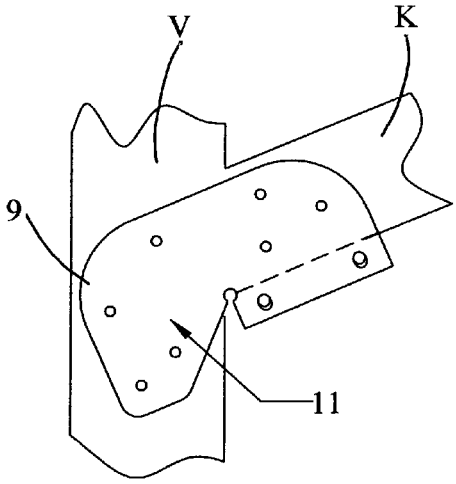
FIG. 2E Side view of a left variable pitch connector on a shallow-slope knee-brace.

Refer now to FIG. 2D which shows a side view of the variable pitch connector 11, shown on FIG. 2C, mounted in the obtuse angle between the vertical member V and the knee brace K. This is a steeply-sloped knee brace, and the variable pitch connector 11 fits easily. FIG. 2E shows the same connector on a shallower knee brace K. FIG. 2F shows how the connector can fit on a horizontal H and vertical member V. In all three views, the variable pitch connector has full contact with the structural members K and V. Also, the taunt web 9 has maintained full contact while being rotated.

Figure 2G:
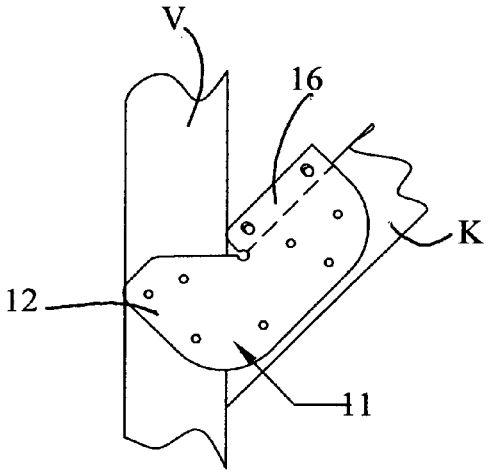
FIG. 2G Side view of a right variable pitch connector on a steep-slope knee-brace.

Refer now to FIG. 2G which shows a left variable pitch connector 11 mounted in the acute bend formed between the vertical member V and knee brace K. For prior art connectors, this would be almost impossible to get nails into the top of the knee brace K. But the angled nailing through the angled face 16 is easy and secure. FIG. 2G could be where the foundation is just below the vertical member, and it would be difficult to nail or screw from the bottom or obtuse angle of the vertical member V and knee brace K.

Figure 2H:
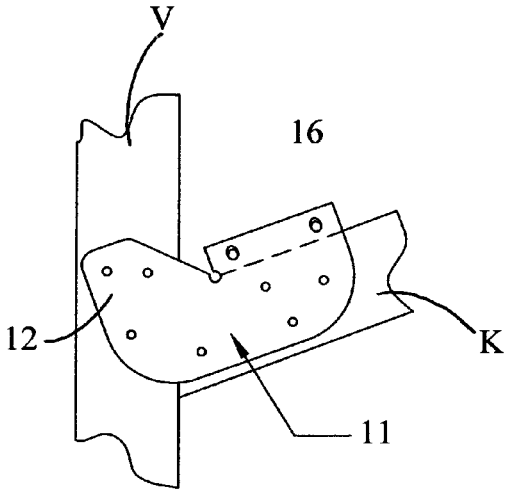
FIG. 2H Side view of a right variable pitch connector on a shallow-slope knee-brace FIG. 2I Side view of a right variable pitch connector on a horizontal member.
Figure 2I:
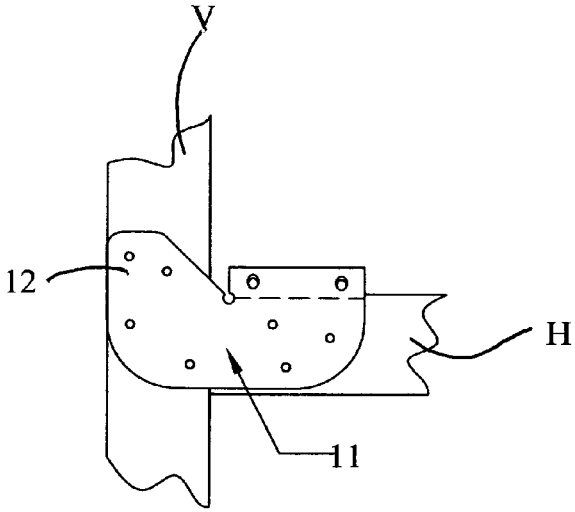
FIG. 2J Side view of a right variable pitch connector on a horizontal member.
FIG. 2K Side view of a right variable pitch connector on a shallow-slope knee-brace FIG. 2L Side view of a right variable pitch connector on a steep-slope knee-brace.
FIG. 2M Simple cross-section showing angled nailing from the left.
FIG. 2N Simple cross-section showing angled nailing from the right.
FIG. 2O Simple cross-section showing nailing from the left and right.
FIG. 2P Flat pattern layout of a left variable pitch connector.
FIG. 2R Perspective view of a knee brace with an added stabilizer member.
FIG. 2S Perspective view of a knee brace with an added stabilizer member.
FIG. 2T Perspective view of a knee brace with stabilizer and connectors.
FIG. 2U Perspective view of a knee brace with an added stabilizer and slope connector.
FIG. 2V Perspective view of a knee brace with an added stabilizer and connectors.
FIG. 2W Perspective view of a knee brace with added connectors.
FIG. 2X Perspective view of gusset connector.
FIG. 2Y Flat pattern layout of a gusset connector.
FIG. 2Z Flat pattern layout showing orientation for tool and die.

Refer now to FIG. 2H which shows a side view of a variable pitch connector 11 on a shallower knee brace K. FIG. 2I shows the variable pitch connector 11 mounted on a horizontal member H and vertical member V. In FIGS. G-I, the stabilizer web 12 maintains contact with the vertical member V, during the rotation of the clip between horizontal and steep pitch.

Figure 2J:
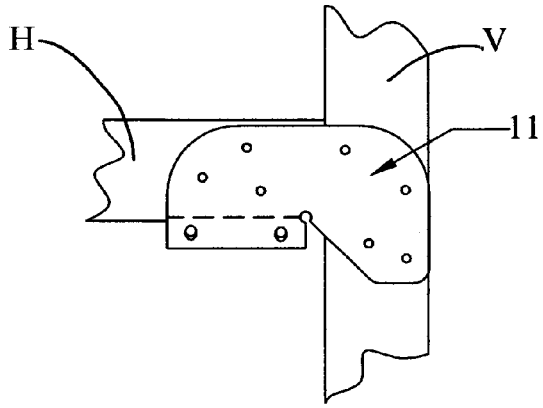
Figure 2K:
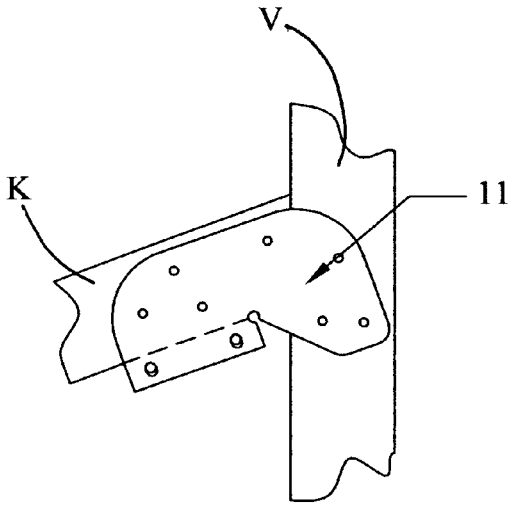
Figure 2L:
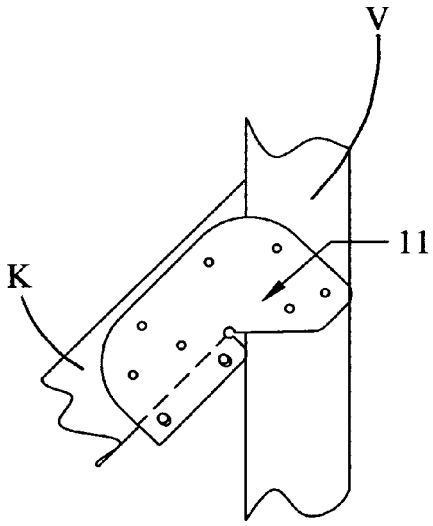

Refer now to FIG. 2J which shows a side view of a variable pitch connector 11 connected to a vertical member V and horizontal member H. FIGS. 2J, 2K and 2L are continuation of FIGS. 2G, 2H, and 2I, so that the knee brace K has made an arc. From steeply pitching up, to steeply pitching down, the variable pitch connector has been able to attach to each angle in between. Also, it has been able to form a connection in the difficult acute angle between the vertical member V and the knee brace K.

Figure 2M:
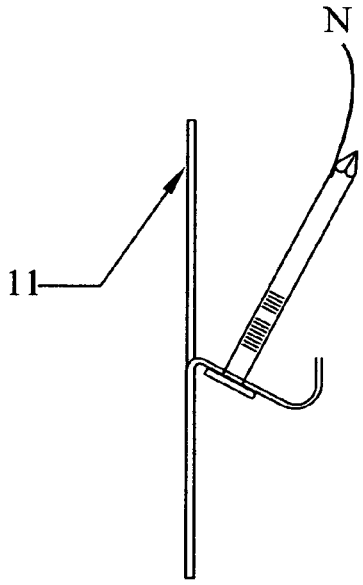
Figure 2N:
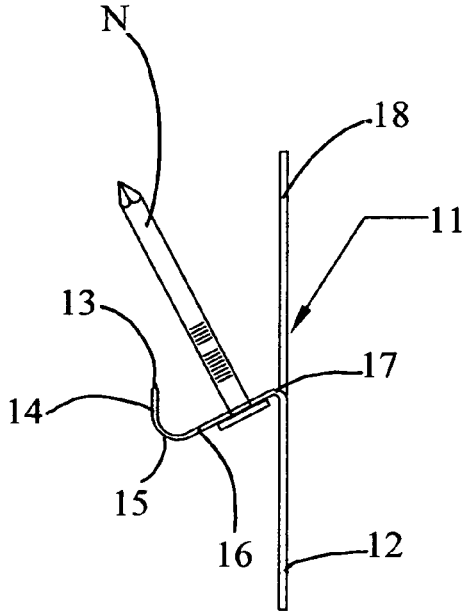

FIG. 2M and FIG. 2N show simple cross-section views of the angle of nails N driven at an angle through the angle face 16. FIG. 2M shows the nail driven from the left, and FIG. 2N shows a nail driven from the right. Using both a left and right variable pitch connector puts the nails N at an angle to each other, like cross-nailing.

Figure 2O:
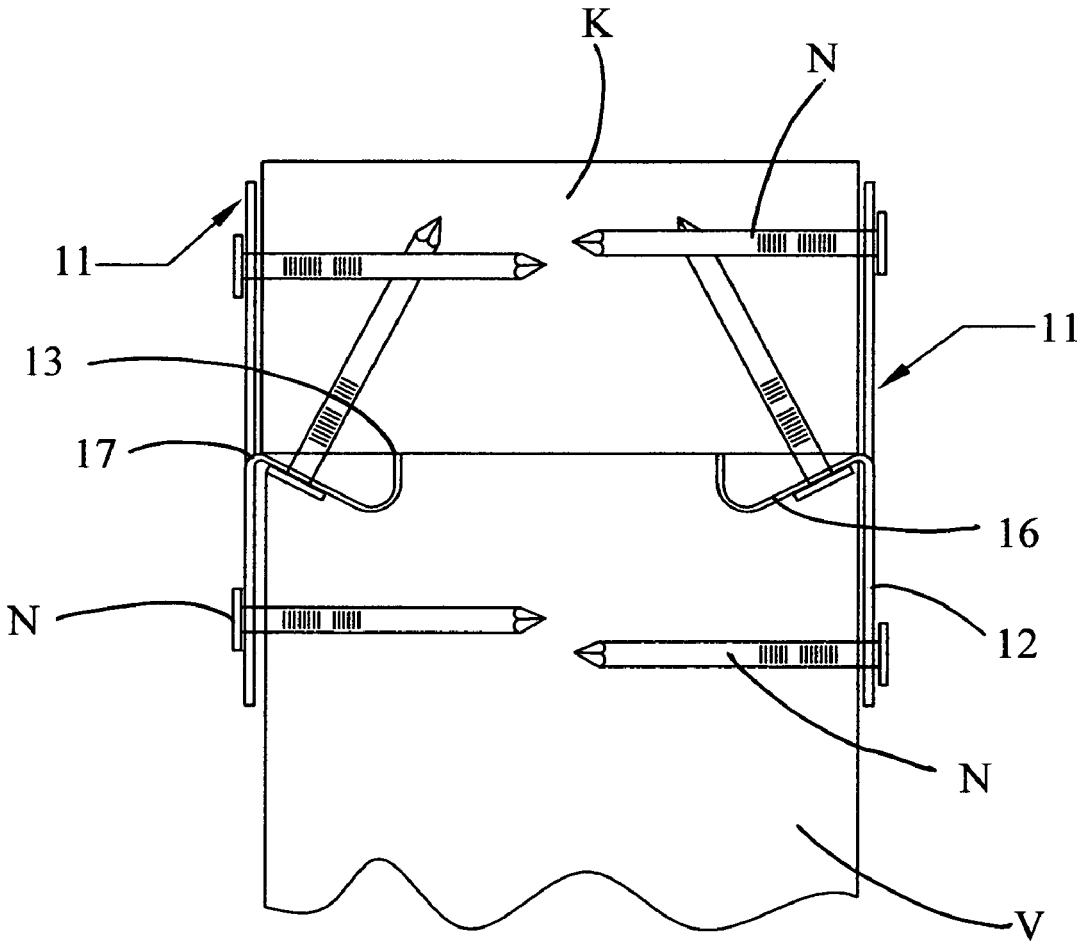

Refer now to FIG. 2O which shows a simple cross-section of some of the nails N from left and right variable pitch connectors 11 into a vertical member V and a sloped knee brace K. There are many more nails not shown. FIG. 2O shows how nails N from the angled face 16 are at an angle to nails N from the plate web 18. Angled nails make detachment more difficult during seismic or wind forces.

Figure 2P:
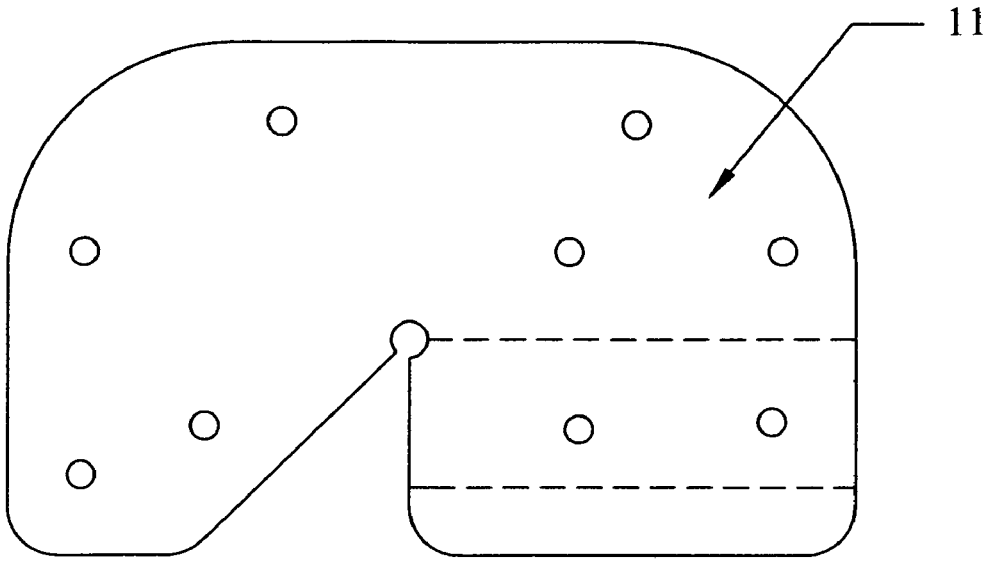

Refer now to FIGS. 2P and 2Q which show preferable flat pattern layouts for a left and right variable pitch connector 11 respectively. The connectors could be closer together for manufacture, so there is less wasted material.

Figure 2R:
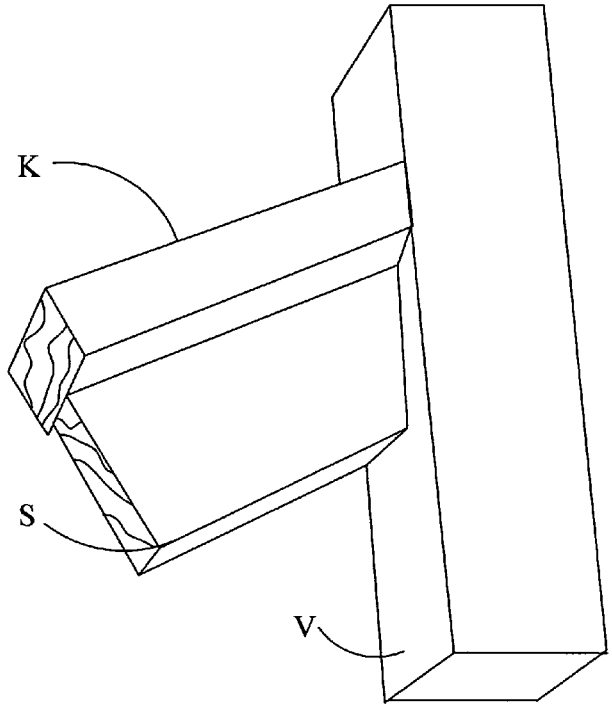
Prior Art Fig. 2R
Figure 2S:
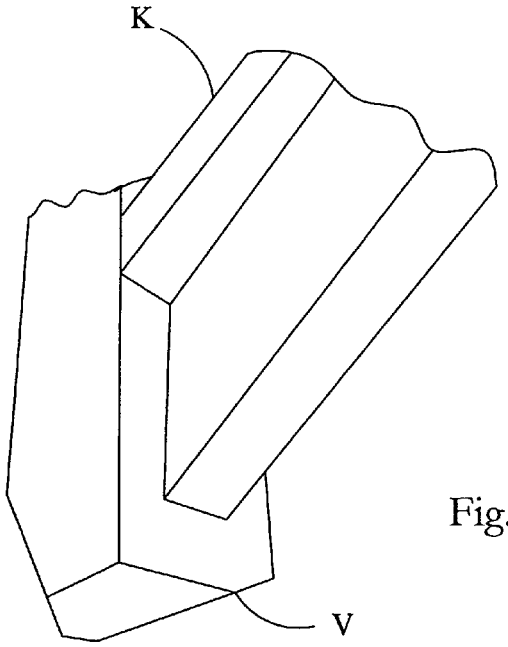
Fig. 2S Prior Art

Refer now to FIGS. 2R and 2S which show a perspective view of one embodiment for fixing the flexibility of a typical knee brace K. A 2×4 could be angled cut at the ends to fit against the vertical member V on the top (FIG. 2R), and the vertical member V on the bottom (FIG. 2S). The brace stabilizer S would be placed in the center of the existing knee brace K. This is an easy cut for a skilled carpenter. FIG. 1H shows a simple cross-section of how the knee brace K would be flush with the new brace stabilizer S and how two slope connectors 1 would attach.

Figure 2T:
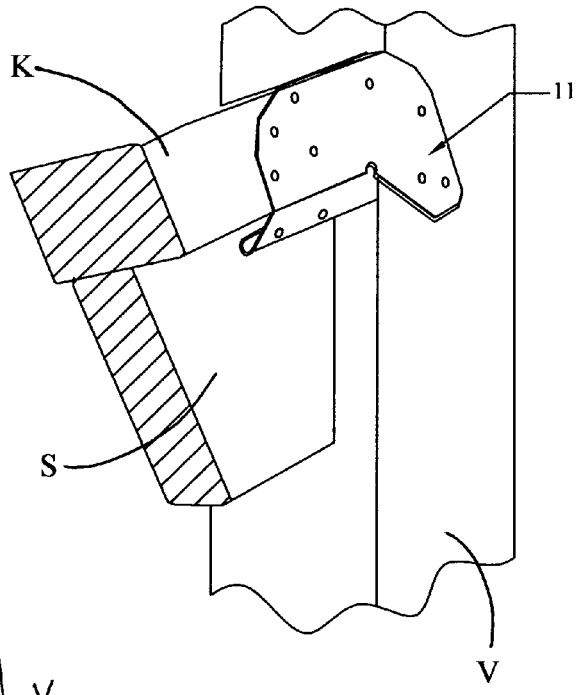

Refer now to FIG. 2T which shows a perspective view of a variable pitch connector 11 attached to the vertical member V and the knee brace K. The variable pitch connector 11 secures the knee brace K tightly to the vertical member V, and a variable pitch connector 11 can be used on the other side.

Figure 2U:
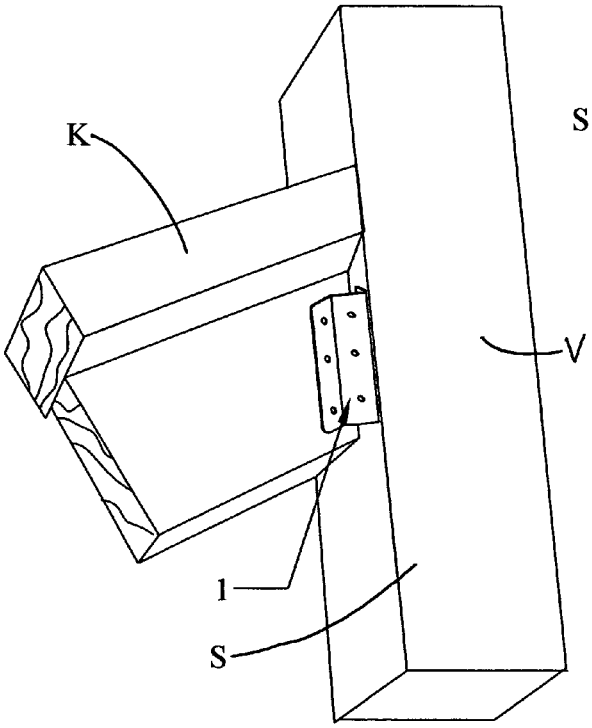

Refer now to FIG. 2U which show a perspective view of the upper end of the sloped knee brace K and brace stabilizer S where they connect with the vertical members V. A slope connector 1 ties the brace stabilizer S, at the top and bottom, securely to the vertical members V. Another slope connector 1 could be used on the other side for more strength.

Figure 2V:
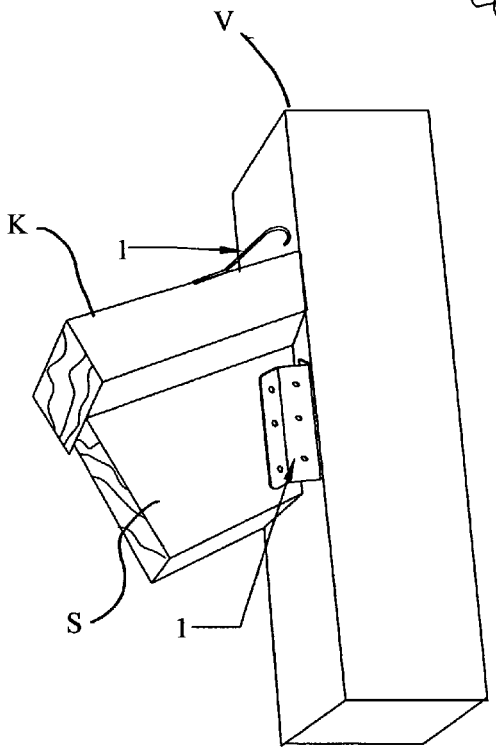

Refer now to FIG. 2V which shows a perspective view of the top of the sloped knee brace K and brace stabilizer S. The bottom would look similar. On both sides of the knee brace K and brace stabilizer S, and at the bottom, a slope connector 1 is shown connecting the brace stabilize S to the vertical members V. Also shown is a variable pitch connector 11, which can be used on both sides, tying the knee brace K securely to the vertical members V.

Figure 2W:
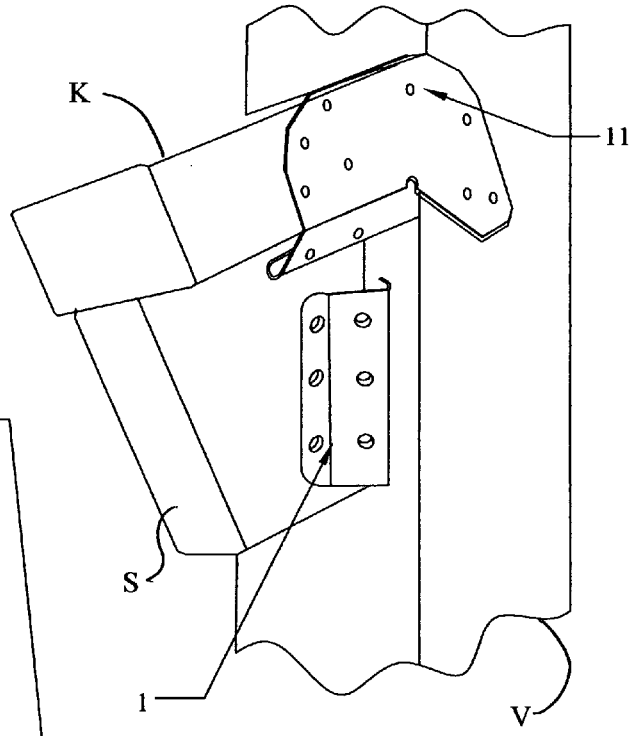

Refer now to FIG. 2W which shows a perspective view of the top of the sloped knee brace K and brace stabilizer S. Here, three slope connectors 1 are used. One is tying the top of the knee brace K to the vertical member V, and two are tying the sides of the brace stabilizer S to the vertical member V.

For even added strength, one could combine FIGS. 2V and 2W. That would make two slope connectors 1 on the brace stabilizer S, two variable pitch connectors 11 on the sides of the knee brace K, and a slope connector 1 on the top of the knee brace K.

It has been shown that the slope connector 1 can work on different slopes. It does this because it can pivot around an imaginary axis on the base web 6, near the base bend 5. The axis is parallel to the base bend 5. Pivoting on this imaginary axis can move the base web 6 and base bend 5 on the sloping member, but always keeps it flush. The angled face 4, radius bend 3, radius web 2, and radius lip 8 rotate around this axis, but the radius web 8 and/or the radius web 2 are always flush on the vertical member. This is shown on FIGS. 1E-1G.

The variable pitch connector 11 can also works on different slopes. It can pivot on an imaginary axis, perpendicular to the plate web 18, near the stress reliever 20. Pivoting on this imaginary axis keeps the stabilizer web 12 and taunt web 9 on the vertical member, while the plate bend 17 is at the edge of the sloping member. That places the angled face 16, radius bend 15, radius web 14, and radius lip 13 parallel to the sloping member. This is shown on FIGS. 2D-2L. Bending of prior art connectors to sloping members by using weak slots is common and a weak connection. Rotation of a connector to fit on sloping members is uncommon and makes for a strong connection.

The unique angled bends that allow angled nailing on the slope connector 1 and on part of the variable pitch connector 11 can also be used on other parts of a connector.

Figure 2X:
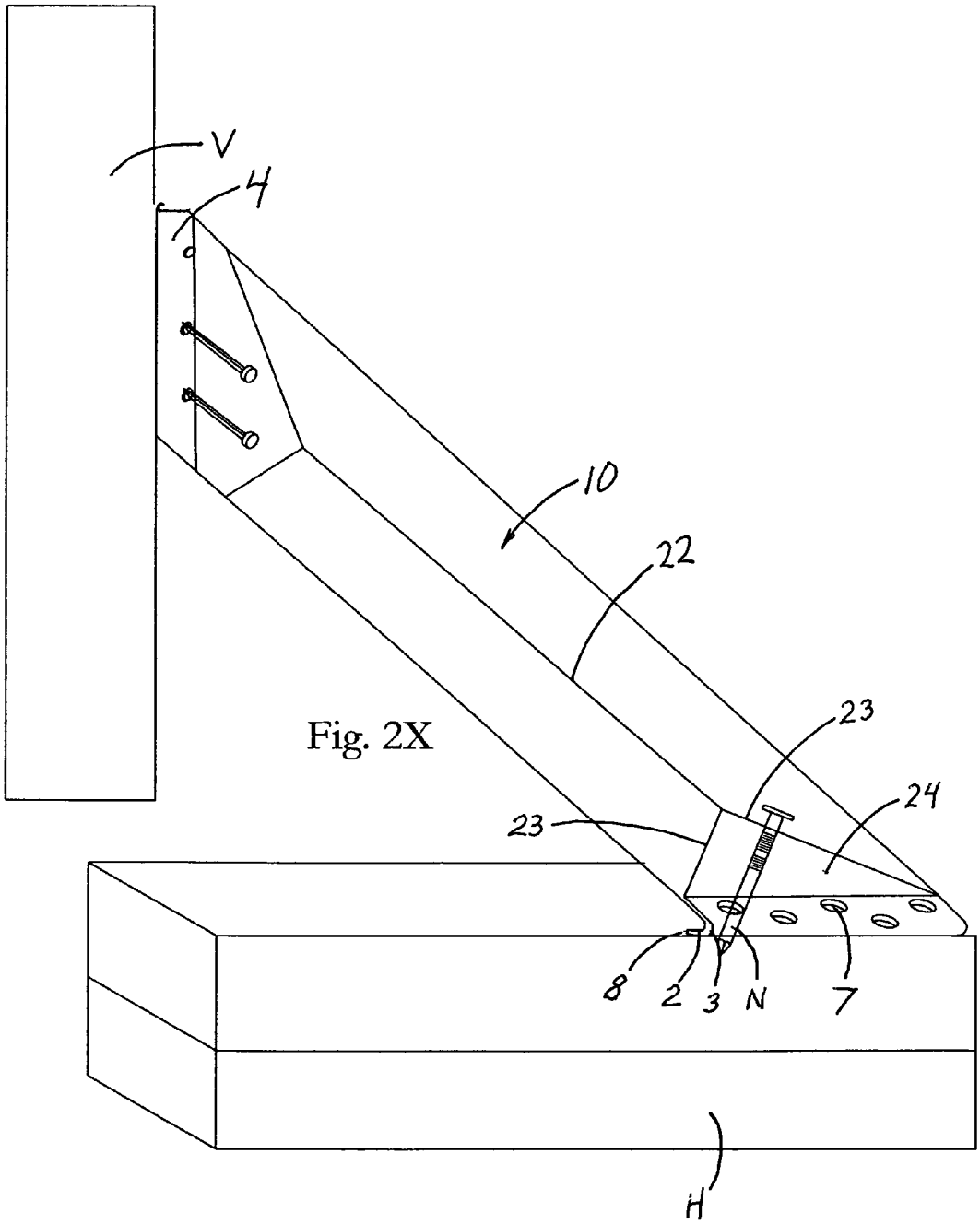

Refer now to FIG. 2X which shows a perspective view of a gusset connector 10. By placing the unique bends and faces on the ends of a trapezoidal shape, a triangular gusset is formed. The inside of the trapezoid-shape is bent into a V-shape by the strengthening bend 22. The ends of the trapezoid-shape are bent into triangles 24 by the triangle leg bends 23. The gusset connector 10 fits on intersecting structural members, but not different slopes.

Although the strengthening bend 22 and triangle leg bends 23 are shown as sharp lines in the drawing, they would be formed out smoothly, more like an embossment. The strengthening bend 22 and triangle leg bends 23 give the gusset connector 10 great strength against the forces of compression, tension, and twisting.

Both ends of the trapezoid-shaped center have part of the slope connector 1 attached or formed onto. An angled face 4 is connected to the triangle 24. The radius bend 3, radius web 2, and radius lip 8 are formed on the end of the angled face 4. The angled faces 4 on opposite ends of the trapezoid-shape are perpendicular to each other. A gusset connector 10 can be used where a typical connector cannot be put on the outside of intersecting structural members because of architectural details, or where the depth is shallow, such as the back of a fence or gate.

The gusset connector 10 is slid between two intersecting members until the radius webs 2 on both ends are flush with them. Then nails N are driven at an angle through the nail holes 7 on the angled faces 4. That would tie the gusset connector 10 tightly to the horizontal member H and vertical member V. The gusset connector 10 would then form a brace between both structural members H and V. The angled faces 4 allow easy nailing and guide the nails N into the heart of the wood.

Figure 2Y:
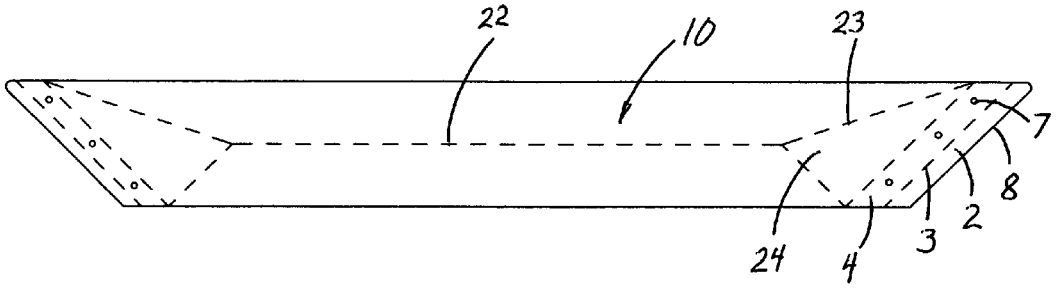
Figure 2Z:
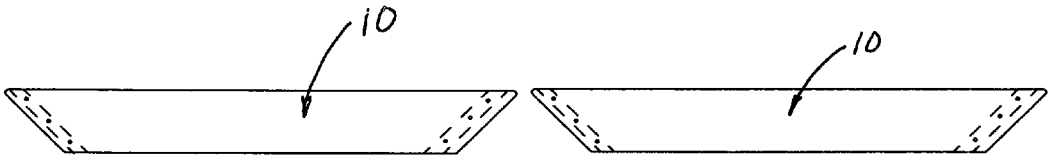

Refer now to FIG. 2Y which is a preferred flat pattern layout of a gusset connector 10. FIG. 2Z shows one embodiment of how the pattern could be fed into the tool and die machine.

The present invention is not limited to use on wood. For example, a steel T-shaped brace stabilizer S could be used under the knee brace K to support it instead of wood. Slope connectors 1 could be nailed to the vertical members V like in FIGS. 2U and 2V, and then riveted or bolted to the steel brace.

Some newer homes are built using metal studs and framing. The sheet-steel studs are hollow and get their strength from bends. Where wood members have to tie into the hollow steel studs, a slope connector 1 or variable pitch connector 10 could be used. Since sheet metal screws are used to tie the steel studs together, screws or bolts could be used to tie sloping or angled members together with slope connectors 1 or variable pitch connectors 11. Steel studs that meet at right angles could be connected using gusset connectors 10. Where plumbing or vent lines are cut through the metal studs, the stud loses strength. A gusset connector could brace the member or wood braces could be cut and connected to the sloped wood/metal interface with slope connectors 1 or variable pitch connectors. These connectors would help strengthen against lateral, twisting and compression loads.

CONCLUSION, RAMIFICATION, AND SCOPE

Thus the reader will see that the unique bends and forms that permit angled nailing can be used on other connectors. Several embodiment of the slope connector can provide a stronger connection between intersecting structural members on a building.

While my above description contains many specificities, these should not be construed as limitations on the scope, but rather as an exemplification of several preferred embodiments thereof. Many other variations are possible. For example, the unique bends and forms that make up the angled nailing could be used on many other connectors that have to fit in tight places or have to fit on sloping members. Bent tabs and dome nailing have been used on joist hangers for years. But an embodiment of a joist hanger using angled nailing would be superior to dome and bent-tab nailing.

The connectors can have different shapes, such as circular, oval, trapezoidal, triangular etc. and they can be made from different materials instead of steel, such as titanium, carbon fiber, fiberglass, plastic, etc. Thus the scope of the embodiments should be determined by the appended claims and their legal equivalents, rather than by the examples given.

I claim:

1. A connector for fastening intersecting structural building members comprising:

a. a substantially flat first web having a top and bottom, and a plurality of nail holes;

b. said first web is substantially L-shaped;

c. said first web has a first bend on one leg of said L-shaped first web;

d. attached to said first bend is a substantially flat and rectangular second web;

e. said second web having a top and bottom, and a plurality of nail holes;

f. said top of said first web is at an obtuse angle to said top of said second web;

g. said second web has an acute bend forming a lip;

h. said first web having substantially rounded corners.

2. The connector of claim 1 wherein said second web has said acute bend on the opposite side of said first bend.

3. The connector of claim 2 wherein said acute bend work-hardens said lip for added strength.

4. The connector of claim 3 wherein said lip adjacent to said acute bend, has a straight plane and is substantially parallel to said first bend.

5. The connector of claim 4 wherein said lip having said straight plane as a means for placement against a side of a beam, when said bottom of the first web is placed against the adjacent side of said beam.

6. The connector of claim 5 wherein said bottom of the first web can be fastened against a beam, and said lip can be fastened to an adjacent side of said beam by fasteners through said nail holes.

7. The connector of claim 6 wherein the inner corner of said first web, between said opposite and adjacent L-shaped legs, can pivot at said inner corner as a means for fitment on angled, intersecting structural members.

8. The connector of claim 7 wherein said first bend between said first web and said second web, and said second bend on the opposite end of the second web forms an angled platform for fasteners driven through said second web at an acute angle to nails driven through said first web, whereby said nails are in different planes of an attached structural member.

9. The connector of claim 8 wherein said acute angle between said fasteners, said fastening on different planes of one structural member, said fastening onto an angled, intersecting structural member, said pivoting around said inner corner for different angles of beams, and said work-hardened lip provide the means for positive attachment of adjacent and angled structural members, thereby helping to prevent damage from wind and seismic events to an existing building.

* * * * *